US012158295B2

(12) United States Patent
Brooks et al.

(10) Patent No.: US 12,158,295 B2
(45) Date of Patent: Dec. 3, 2024

(54) PULSED CRYOGEN FREEZER

(71) Applicant: MVE Biological Solutions US, LLC, Brentwood, TN (US)

(72) Inventors: Jeffrey Brooks, Jasper, GA (US); Douglas Alan Wilcox, II, Cumming, GA (US); Daniel McCall, Kennesaw, GA (US); Chris Payne, White, GA (US)

(73) Assignee: MVE Biological Solutions US, LLC, Brentwood, TN (US)

( * ) Notice: Subject to any disclaimer, the term of this patent is extended or adjusted under 35 U.S.C. 154(b) by 0 days.

(21) Appl. No.: 17/985,559

(22) Filed: Nov. 11, 2022

(65) Prior Publication Data

US 2024/0159433 A1 May 16, 2024

(51) Int. Cl.
*F25B 9/14* (2006.01)

(52) U.S. Cl.
CPC ..... *F25B 9/145* (2013.01)

(58) Field of Classification Search
CPC ..... F25B 9/145; F25B 2600/2521; F25B 2600/2519; F25B 41/347
USPC ..... 62/6
See application file for complete search history.

(56) References Cited

U.S. PATENT DOCUMENTS 5,309,722 A * 5/1994 Phillips, Jr. ..... F25D 3/10 62/52.1
2013/0152608 A1 6/2013 Wray
2013/0296811 A1* 11/2013 Bangera ..... A61B 18/0218 604/290
2016/0177934 A1 6/2016 Takahashi
2019/0137163 A1 5/2019 Chart
2022/0026278 A1* 1/2022 Wang ..... G01J 5/0022
2023/0023822 A1* 1/2023 Corey ..... F25D 11/04
2023/0384016 A1* 11/2023 Corey ..... F25D 3/105

FOREIGN PATENT DOCUMENTS

KR 10-1558839 B1 10/2015
KR 10-2018-0119069 A1 11/2018

OTHER PUBLICATIONS

KIPO; International Search Report and Written Opinion dated Feb. 14, 2024 in International Application No. PCT/US2023/036491.

* cited by examiner

*Primary Examiner* — Nael N Babaa
(74) *Attorney, Agent, or Firm* — Snell & Wilmer L.L.P.

(57) ABSTRACT

A cryogenic freezer and a method of controlling temperature within the cryogenic freezer. The cryogenic freezer includes an inner vessel. The inner vessel defines a storage chamber. The cryogenic freezer includes an outer vessel surrounding the inner vessel. The outer vessel may define a vacuum-insulated space in between the outer vessel and the inner vessel. The cryogenic freezer includes a temperature sensor configured to measure a temperature within the storage chamber. The cryogenic freezer includes a controller coupled to the temperature sensor. The controller is configured to pulse an amount of cryogen into the storage container to control the temperature within the storage container.

17 Claims, 5 Drawing Sheets

PULSED CRYOGEN FREEZER

BACKGROUND

1. Field

This specification relates to a system, device, or apparatus for a cryogenic freezer and a method of controlling temperature within the cryogenic freezer.

2. Description of the Related Art

Vapor phase liquid cryogen freezers have been used for several decades for long term storage of biological specimens, which are heat sensitive. These freezers store the biological samples, materials, products and the like using cryogenic liquids, such as a refrigerant. These freezers may have a reservoir of liquid cryogen, such as liquid nitrogen, in the bottom of the freezer storage chamber with the product stored above the reservoir or partly submerged within the cryogenic liquid. The freezers may be a dewar, which may feature a double-walled, vacuum insulated construction so that the storage chamber is well insulated. Such freezers may provide storage temperatures ranging from approximately −90° C. to −195° C.

The temperature in these freezers may not be directly controlled. Instead, the temperature may be controlled by maintaining the amount of cryogenic liquid in the reservoir. The temperature of the freezer storage compartment may vary depending upon the amount of liquid cryogen in the freezer. Moreover, there is a concern that submerging biological specimens in the cryogenic liquid presents a risk of cross-contamination between specimen containers. Even when the stored specimen containers are placed in the cold vapor above the cryogenic liquid reservoir, there exists a potential for the specimen or specimen container to contact or be submerged within the cryogenic liquid if the freezer is overfilled with the cryogenic liquid.

Accordingly, there is a need for a system and a method to manage and control the temperature within the freezer while preventing the specimen from becoming submerged in the liquid cryogen.

SUMMARY

Examples described herein relate to embodiments of a freezer and a method of controlling temperature within a cryogenic freezer. The freezer includes an outer vessel and an inner vessel within the outer vessel. The inner vessel defines a storage chamber. The freezer includes a sensor that measures a temperature within the storage chamber. The freezer may include multiple sensors that measure temperatures within the storage chamber. The freezer includes a controller coupled to the first sensor. The controller pulses an amount of medium into the storage container to control the temperature within the storage container. The medium may be a liquid or gaseous cryogen refrigerant including liquid nitrogen.

In one aspect, the invention is embodied in a freezer. The freezer includes an outer vessel and an inner vessel. The inner vessel is positioned within the outer vessel. The inner vessel defines a storage chamber. The freezer includes a first sensor configured to measure a temperature within the storage chamber. The freezer includes a controller coupled to the first sensor. The controller is configured to pulse an amount of medium into the storage container to control the temperature within the storage container.

These and other embodiments may optionally include one or more of the following features. The freezer may include a turn tray. The turn tray may be positioned within the inner vessel. The turn tray may be configured to hold a number of storage areas. The first sensor may be positioned adjacent to the turn tray. The first sensor may be positioned on the turn tray. A second sensor may be positioned at a bottom of the turn tray. The second sensor may be configured to detect or measure the amount of medium within the storage chamber. The controller may be configured to pulse the amount of medium within the storage chamber further based on the detected or measured amount of medium within the storage chamber. The controller may be configured to decrease a frequency or a timing of the pulse when the detected or measured amount of medium within the storage chamber is greater than or equal to a threshold amount or when the temperature is less than a threshold temperature. To pulse the amount of medium within the storage chamber, the controller may be configured to increase the frequency or the timing of the pulse when the detected or measured amount of medium within the storage chamber is less than the threshold amount and when the temperature is greater than the threshold temperature.

The freezer may further include an outlet that is positioned at a bottom, side wall, or other location of a storage vessel to allow dispensing of medium into a sample space around a turn tray. The freezer may further include an outlet that is positioned at a bottom of the storage chamber and configured to deliver or disperse medium into the storage chamber. The outlet may be a valve, an end to a tube, or another outlet structure. The freezer may further include a medium source that is in fluid communication with the outlet and configured to provide the medium through one or more conduits and out the outlet to deliver or disperse the medium into the storage chamber. The controller may be coupled to the medium source and the outlet. To pulse the amount of medium into the storage container, the controller may be configured to adjust a position of a valve of the outlet to open, partially open, or close the valve or control the medium source to provide the medium through the outlet. The medium source may be a storage container containing a supply of the medium. The medium may be a liquid cryogen refrigerant including liquid nitrogen. The liquid nitrogen may be pressurized for transfer to the outlet.

The controller may be configured to determine a timing or a frequency of the pulsing of the amount of medium into the storage container. The controller may be configured to pulse the amount of medium into the storage container based on the timing or the frequency. The controller may be configured to determine a difference between the temperature within the storage temperature and a set point temperature. The controller may be configured to determine the timing or the frequency of the pulsing of the amount of medium into the storage container based on the difference.

In another aspect, the invention is embodied in a freezer for using liquid cryogen as a refrigerant. The freezer may include an inner vessel defining a storage chamber. The freezer may include an outer vessel surrounding the inner vessel. The outer vessel may define a vacuum-insulated space in between the outer vessel and the inner vessel. The freezer may include a temperature sensor configured to measure a temperature within the storage chamber at a determined height. The freezer may include a controller coupled to the temperature sensor. The controller is configured to pulse an amount of cryogen into the storage container to control the temperature within the storage container. The controller may be configured to pulse an amount of liquid into the storage container to control the temperature within the storage container and also limit an amount of liquid that pools and/or collects at a bottom of the storage container.

These and other embodiments may optionally include one or more of the following features. The freezer may include a turn tray positioned within the inner vessel. The turn tray may be configured to hold a number of storage areas. The temperature sensor may be positioned on or adjacent to the turn tray. The freezer may include a cryogen level sensor positioned at a bottom of the turn tray. The cryogen level sensor may be configured to detect or measure the amount of cryogen within the storage chamber. The controller may be configured to pulse the amount of cryogen within the storage chamber further based on the detected or measured amount of cryogen within the storage chamber. To pulse the amount of cryogen within the storage chamber, the controller may be configured to decrease a frequency or a timing of the pulse when the detected or measured amount of cryogen within the storage chamber is greater than or equal to a threshold amount or when the temperature is less than a threshold temperature. The controller is further configured to increase the frequency or the timing of the pulse when the detected or measured amount of cryogen within the storage chamber is less than the threshold amount or when the temperature is greater than the threshold temperature.

The freezer may further include an outlet that is positioned at a bottom of the storage chamber. The outlet may be an outlet valve. The outlet valve may be configured to deliver or disperse cryogen (e.g., liquid cryogen) into the storage chamber. The freezer may further include a cryogen source that is in fluid communication with the outlet valve and configured to provide the cryogen through one or more conduits and out the outlet valve to deliver or disperse the medium into the storage chamber. The controller may be coupled to the cryogen source and the outlet valve. To pulse the amount of cryogen into the storage container, the controller may be configured to adjust a position of the outlet valve to open, partially open, or close the outlet valve, or control the cryogen source to provide the cryogen through to the outlet valve. The cryogen source may be a storage container containing a supply of the cryogen that includes liquid nitrogen. The liquid nitrogen may be pressurized for transfer to the outlet valve.

In another aspect, the invention is embodied in a method for controlling temperature within a cryogenic freezer. The method includes measuring or detecting a temperature within a storage chamber of the cryogenic freezer by a processor and using a temperature sensor. The method includes determining whether the temperature is greater than or equal to a set-point temperature by the processor. The method includes pulsing an amount of cryogen into the storage chamber when the temperature is greater than or equal to the set-point temperature by the processor and using an outlet valve and a cryogen source.

These and other embodiments may optionally include one or more of the following features. The method may include measuring or detecting the amount of cryogen in the storage chamber by the processor and using a cryogen level sensor. The method may include pulsing the amount of cryogen into the storage chamber based on the amount of cryogen in the storage chamber by the processor and using the outlet valve and the cryogen source. Pulsing the amount of liquid within the storage chamber may include decreasing a frequency or a timing of the pulse when the detected or measured amount of cryogen within the storage chamber is greater than or equal to a threshold amount or when the temperature is less than a threshold temperature. Pulsing the amount of cryogen within the storage chamber may include increasing the frequency or the timing of the pulse when the detected or measured amount of cryogen within the storage chamber is less than the threshold amount or when the temperature is greater than the threshold temperature.

The method may include determining a difference between the temperature within the storage chamber and the set-point temperature. The method may include determining a timing or a frequency of the pulsing of the amount of cryogen into the storage chamber based on the difference. The method may include pulsing the amount of cryogen into the storage chamber based on the timing or the frequency.

BRIEF DESCRIPTION OF THE DRAWINGS

Other systems, methods, features, and advantages of the present invention will be apparent to one skilled in the art upon examination of the following figures and detailed description. Component parts shown in the drawings are not necessarily to scale and may be exaggerated to better illustrate the important features of the present invention.

DETAILED DESCRIPTION

Disclosed herein are systems, devices, or apparatuses for a freezer, particularly a freezer for using pulsed cryogen as a refrigerant, and a method of controlling temperature within a cryogenic freezer system. Current freezer technology uses expensive heat exchangers and complex assembly processes to address the risk of exposing material stored within the cold storage space to liquid cryogen (e.g., by submerging the samples in the cryogen). References to cryogen throughout may include liquid cryogen, gaseous cryogen, or a combination of liquid and gaseous cryogen. The pulsed cryogen freezer eliminates the need for the heat exchangers while reducing the risk of liquid nitrogen exposure. The pulsed cryogen freezer maintains the temperature within the payload area of the pulsed cryogen freezer while also controlling the level of cryogen within the payload area of the pulsed cryogen freezer so that the specimen in the payload area does not become submerged or contact the cryogen within.

Other benefits and advantages of the pulsed liquid nitrogen freezer include the capability to expand the usable storage temperature range of the pulsed liquid nitrogen freezer. For example, the usable storage temperature range may expand from −185° C. to −195° C. to −20° C. to −150° C. Moreover, the pulsed liquid nitrogen freezer may be retro-fitted to couple or connect to various different types of high efficiency liquid nitrogen-based freezers. Additionally, the pulsed liquid nitrogen freezer may be configured to be adapted to the various different types of high efficiency liquid nitrogen-based freezers so that the freezers may be applied to various applications.

Figure 1:
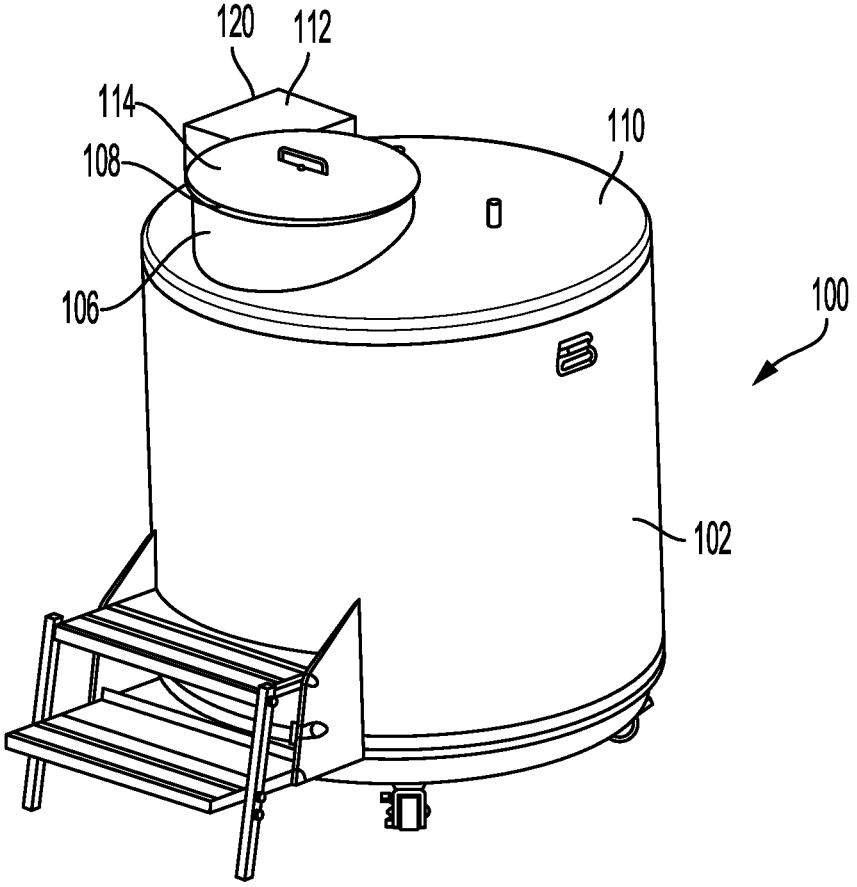
FIG. 1 is a perspective view of a cryogenic freezer according to an aspect of the invention.

FIG. 1 is a perspective view of a cryogenic freezer 100. The cryogenic freezer 100 includes a dewar 102. The dewar 102 may be cylindrical or have an alternative shape. The dewar 102 may be a double-walled flask or container with a vacuum-insulated space between the walls. The dewar 102 may be used to hold a liquid below ambient temperatures. Temperature-sensitive materials, such as biological samples, may be stored at a low temperature inside the dewar 102.

The cryogenic freezer 100 may have an access neck 106. The access neck 106 may be positioned on top of the dewar 102 and define an access opening 108 through which the inside of the dewar 102 may be accessed. The cryogenic freezer 100 may have a top 110. The top 110 may include a removable plate 114 (also called the "Dewar lid") that covers the access opening 108.

Figure 3:
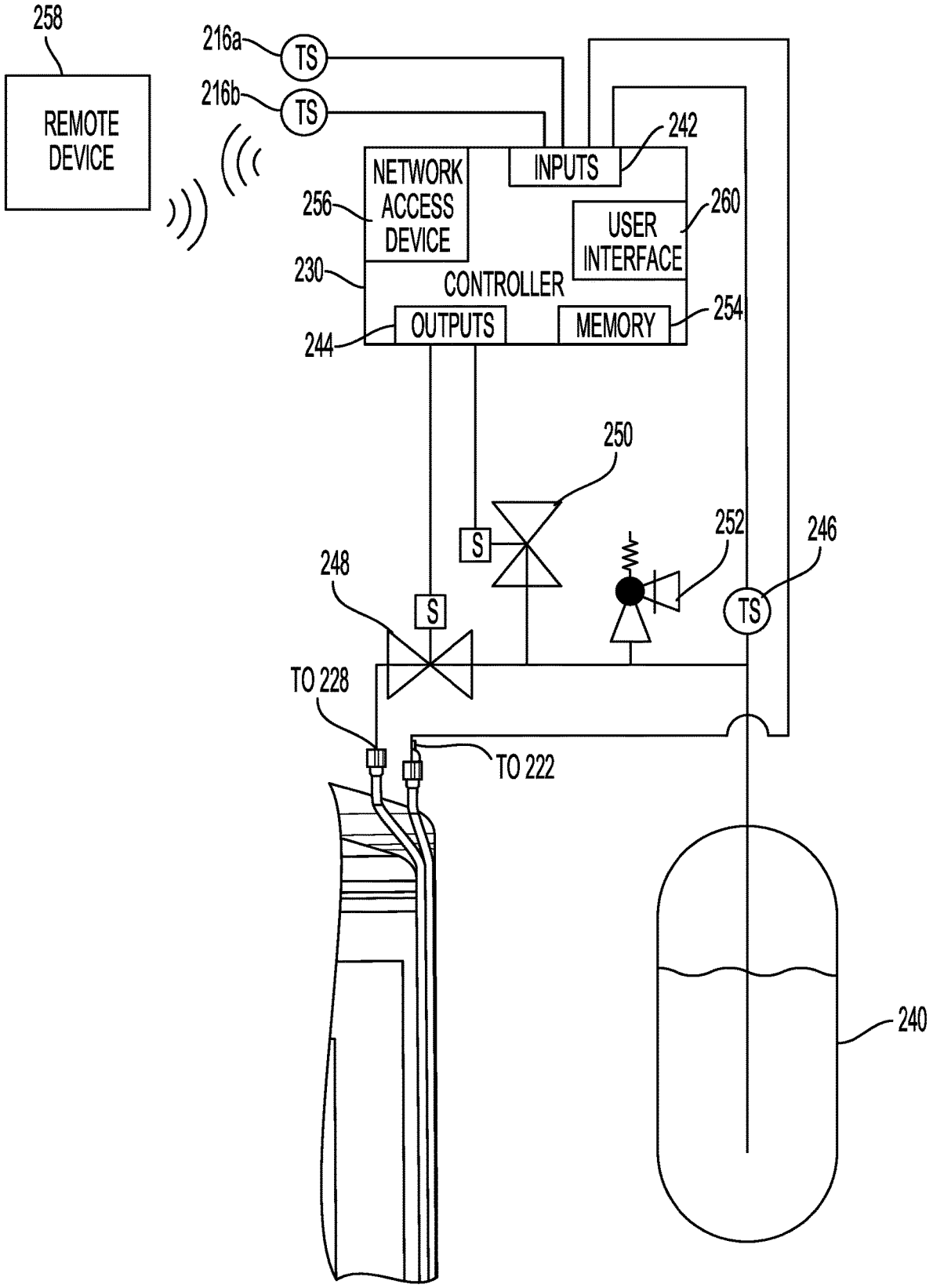
FIG. 3 is a schematic diagram of external connections of the cryogenic freezer of FIG. 1 according to an aspect of the invention.

The cryogenic freezer 100 may include a housing 112. The housing 112 may be positioned on top of the dewar 102. A control panel 120 may be mounted in a front wall of the housing 112. The control panel 120 may include a touch screen and a display. The control panel 120 may be accessed, viewed, and/or configured. The housing 112 may house one or more electronic components. In some embodiments, the one or more components may include a controller 230, as shown in FIG. 3 for example.

Figure 2:
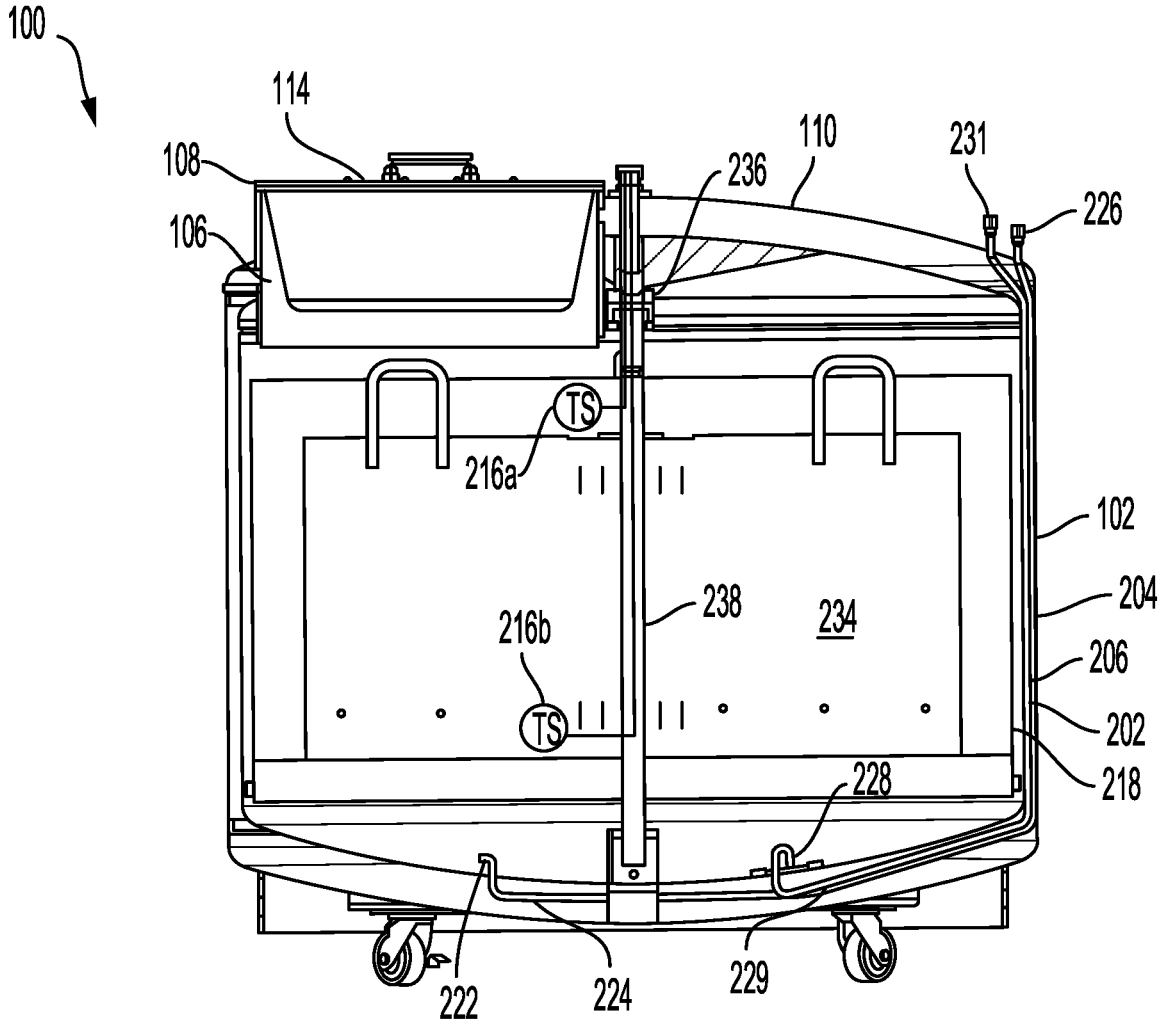
FIG. 2 is a cross-sectional view of the cryogenic freezer of FIG. 1 according to an aspect of the invention.

FIG. 2 is a cross-sectional view of the cryogenic freezer 100. The dewar 102 of the cryogenic freezer 100 may include an outer wall 204 and inner wall 202. The outer wall 204 and/or inner wall 202 may be constructed of a material that includes stainless steel, aluminum alloy or other metal or non-metal that resists cryogenic temperatures. The outer wall 204 may surround the inner wall 202. The outer wall 204 may define an enclosed space 206 inside which the inner wall 202 is positioned. The inner wall 202 may define a storage chamber 234 in which materials, such as biological samples, may be stored at a below ambient temperature, such as at cryogenic temperatures. The space 206 between the outer wall 204 and inner wall 202 may be evacuated of air to provide vacuum insulation. The space 206 may include other types of insulation and one or more physical insert configured to reduce heat transfer through the space 206. In some embodiments, another form-factor and insulated enclosure or vessel may be a substitute for the vacuum insulated dewar 102.

The access neck 106 on top of the dewar 102 may define the access opening 108 through which the storage chamber 234 of the dewar 102 may be accessed. The top 110 of the cryogenic freezer may include a removable top plate 114 that covers the access opening 108. The top plate 114 may be insulated. The top plate 114 of the top 110 may be opened and closed to provide access to the storage chamber 234 through the access opening 108.

The cryogenic freezer 100 may include one or more temperature sensors 216*a,b* and/or a cryogen level sensor 222. The temperature sensors 216*a,b* may be a thermocouple device. The thermocouple device produces a temperature-dependent voltage, and the voltage may be interpreted to measure temperature. A temperature sensor 216*a* may be located adjacent the top of the cylindrical shaft 238 of the turn tray. The temperature sensor 216*a* may be located at the top of the cylindrical shaft 238 of the turn tray 218, which may be the warmest point within the storage chamber 234. The temperature sensor 216*a* may measure or detect the temperature within the storage chamber 234, and when positioned at the top of the cylindrical shaft 238 and/or furthest away from the cooling source, measure or detect the warmest temperature within the storage chamber 234. The temperature sensor 216*b* may be positioned below the turn tray 218. The temperature sensor 216*b* may be positioned adjacent the bottom of the cylindrical shaft 238 of the turn tray 218. In various embodiments, the temperature sensor 216*b* may be positioned at the bottom of the cylindrical shaft 238 of the turn tray 218. The temperature sensor 216*b* may measure or detect the temperature closest to the medium pooling or located within the bottom of the storage chamber 234. The temperature sensor 216*b* may also be used to measure or detect an amount of medium, such as an amount of cryogen, within the storage chamber 234. For example, when the temperature sensor 216*b* falls below a threshold temperature, such as approximately −190° C., this may indicate that the temperature sensor 216*b* is submerged within the medium, such as cryogen (e.g., liquid cryogen) or nitrogen, and thus, the payload may be in contact or submerged within the medium. This ensures that the payload is not submerged and/or does not contact the medium that may be pooling within the bottom of the storage chamber 234. The one or more temperature sensors 216*a,b* may provide a feedback to the controller 230 so that the controller 230 may determine whether the payload within the storage chamber 234 is in contact with or submerged within the medium, and particularly, in contact with or submerged within the liquid medium.

The cryogenic freezer 100 may include a cryogen level sensor 222. The cryogen level sensor 222 may measure or detect the level of the medium within the storage chamber 234. The cryogen level sensor 222 may work in combination with the temperature sensor 216*b* to detect the amount or level of medium that is pooling within the bottom of the storage chamber 234 to determine whether the payload is in contact with or submerged within the medium. The cryogen level sensor 222 may be coupled to the controller 230 via a connection tube 224. The connection tube 224 may be annular. The connection tube 224 may have an outlet 226 on the top 110.

The cryogenic freezer 100 may include a turn tray 218. The turn tray 218 may be located within the inner wall 202. The turn tray 218 may hold a number of storage areas. The storage areas may store temperature-sensitive samples, such as biological materials. An actuator 236 may be coupled to the turn tray 218. The actuator 236 may rotate, spin, move, or otherwise position the turn tray 218. The turn tray 218 may have a cylindrical shaft 238 that extends downward in the storage chamber 234. The actuator 236 may rotate the cylindrical shaft 238. In some implementations, the temperature sensor 216*a,b* may both be located on the cylindrical shaft 238 on the turn tray 218 or elsewhere within the storage chamber 234. The controller 230 may control the actuator 236 to rotate or position the turn tray 218 to provide access to the temperature-sensitive samples stored in the different storage sections of the turn tray 218 when the top 110 is opened. The turn tray 218 may be accessed through the access opening 108 or by removing the top 110. Moreover, by rotating or turning the turn tray 218, the cryogenic freezer 100 may circulate the air and uniformly cool the inside of the storage chamber 234.

The cryogenic freezer 100 may include an outlet 228. The outlet may be a valve. The outlet 228 may be positioned at the bottom of the storage chamber 234. The outlet 228 may be coupled to the controller 230 via a connection tube 229. The connection tube 229 may have an inlet 231 on the top 110. The outlet 228 may be configured to deliver or disperse the medium, such as the cryogen, into the storage chamber 234. The outlet 228 may be in fluid communication with a cryogen source 240 or other medium source. The cryogen source 240 may be configured to provide a medium, such as the cryogen, through the connection tube 229 and deliver or disperse the cryogen or other medium into the storage chamber 234 out of the outlet 228. The delivered cryogen may include liquid nitrogen. In some embodiments, the delivered cryogen may be a mixture of liquid and gas and/or other medium. The outlet 228 may point towards the bottom of the inner wall 202 to encourage pulsed cryogen to diffuse and vaporize, thereby reducing pooling of cryogen and enhancing convective heat transfer.

FIG. 3 is a schematic diagram of external connections of the cryogenic freezer 100. The controller 230 may be a microprocessor or other electronic programmable device. The controller 230 may have input ports 242 and output ports 244. The temperature sensors 216*a,b*, the cryogen level sensor 222, and a cryogen inlet temperature sensor 246 may be in communication with the controller 230 and coupled to the input ports 242. A cryogen pulse control valve 248 and a gas bypass valve 250 may be controlled by the controller 230 and coupled to the output ports 244.

The temperature sensor 216*a* may measure or detect a temperature inside the storage chamber 234. The controller 230 may receive the measured or detected temperature via the input port 242. The temperature sensor 216*a* may take the temperature at or near the warmest point within the storage chamber 234. The temperature sensor 216*b* may measure or detect a temperature inside the storage chamber 234 closest to the medium pooling at the bottom of the storage chamber 234. The controller 230 may receive the measured or detected temperature via the input port 242. The temperature sensor 216*b* may take the temperature at or near a lowest point of the storage chamber 234. The controller 230 may determine a difference between the temperature and the set point temperature. The controller 230 may determine a timing, a frequency, and/or a length of the pulsing of the cryogen into the storage chamber 234 based on the difference. In some embodiments, the controller 230 may compare the temperature to a threshold temperature. The threshold amount may be stored in a local or external memory 254 or on a cloud server. The controller 230 may decrease the timing or the frequency of the pulse when the temperature is less than the threshold temperature. The controller 230 may increase the timing, the frequency, and/or the length of the pulse when the temperature is greater than the threshold temperature.

The controller 230 may control the pulse duration or length. The control of the pulse duration or length may be based on the desired user operating temperature and dimensions of the storage chamber 234. Pulse duration may be directly proportional to the dimensions of the storage chamber 234 and inversely proportional to the desired user operating temperature. Pulse duration limits may be based on historical control and/or use data.

The memory 254 may be coupled to the controller 230 and store instructions that the controller 230 executes. The memory 254 may include one or more of a Random Access Memory (RAM), Read Only Memory (ROM), USB storage device or other volatile or non-volatile memory. The memory 254 may be a non-transitory memory or a data storage device, such as a hard disk drive, a solid-state disk drive, a hybrid disk drive, or other appropriate data storage, and may further store machine-readable instructions, which may be loaded and executed by the processor.

The temperature sensor 216*b* and/or cryogen level sensor 222 may measure or detect the amount of medium, such as cryogen, within the storage chamber 234. The controller 230 may receive the measured or detected amount of cryogen within the storage chamber 234 via the input port 242. The controller 230 may pulse cryogen into the storage chamber 234 based on the measured or detected amount of cryogen within the storage chamber 234 to prevent the filling of the cryogen to pool within the bottom of the storage chamber 234 and contact the payload. The controller 230 may compare the measured or detected amount of cryogen to a threshold amount. The threshold amount may be stored in a local or external memory 254 or on a cloud server. The controller 230 may decrease a frequency, a timing and/or a length of the pulse when the measured or detected amount of cryogen within the storage chamber 234 is greater than or equal to a threshold amount. The controller 230 may increase the frequency, the timing and/or the length of the pulse when the measured or detected amount of cryogen within the storage chamber 234 is less than the threshold amount and cooling is needed to maintain the temperature below the set-point temperature.

The cryogen inlet temperature sensor 246 may measure or detect a temperature of the cryogen at an outlet of the cryogen source 240 prior to the cryogen entering the inlet 231. The controller 230 may receive the measured or detected cryogen inlet temperature via the input port 242. The controller 230 may compare the detected cryogen inlet temperature to the temperature of the storage chamber 234. If the cryogen inlet temperature is greater than the temperature of the storage chamber 234, the controller 230 may control the gas bypass valve 250 to prevent cryogen in gas form that is higher in temperature than the storage chamber 234 from entering the storage chamber 234 during a cooling cycle. Once the cryogen temperature equals the set point temperature inside the storage chamber 234, the controller 230 may control the gas bypass valve 250 to allow cryogen into the storage chamber 234.

The cryogen pulse control valve 248 may pulse cryogen into the storage chamber 234 to control the temperature within the storage chamber 234. The controller 230 may control the cryogen pulse control valve 248 to open, partially open, or close. In the open state, the cryogen pulse control valve 248 may allow cryogen into cryogenic freezer 100 through the inlet 231. In the partially open state, the cryogen pulse control valve 248 may allow less cryogen into the cryogenic freezer 100 through the inlet 231 than the open state. In the closed state, the cryogen pulse control valve 248 may stop the delivery cryogen into the cryogenic freezer 100. The controller 230 may pulse the cryogen by turning the one or more valves into an "ON" or "OPEN" state and then "OFF" or "CLOSED" state and cycling between the different states for different or same lengths of time.

A supply plumbing relief valve 252 may be situated between the cryogen source 240 and the cryogen pulse control valve 248. The supply plumbing relief valve 252 may open or close to create a difference in pressure between the cryogen source 240 and the cryogen pulse control valve 248. In the open position, the supply plumbing relief valve 252 may release pressure to adjust the pressure differential. In the closed position, the supply plumbing relief valve 252 may maintain an existing pressure. The pressure differential may allow the medium, such as cryogen, to travel from the cryogen source 240 to the cryogen pulse control valve 248. In some embodiments, there may be a pump instead of the supply plumbing relief valve 252 to pump the cryogen from the cryogen source 240 to the cryogen pulse control valve 248.

The cryogen source 240 may be a tank storing the medium, such as cryogen, under pressure. The medium may be a liquid cryogen, such as liquid nitrogen. The cryogen may evaporate while being transported through the plumbing to the cryogen pulse control valve 248. When gaseous cryogen temperature is greater than the temperature of the storage chamber 234, the controller 230 may control the gas bypass valve 250 to prevent the gaseous cryogen that has a higher temperature than the set-point temperature from entering the storage chamber 234. When the gaseous cryogen cools to a temperature equal to or less than the temperature of the storage chamber 234, the controller 230 may control the gas bypass valve 250 to allow the gaseous cryogen or a mixture of liquid and gaseous cryogen to enter the storage chamber 234. Allowing gaseous cryogen or a mixture of liquid and gaseous cryogen to enter the storage chamber 234 to cool the storage chamber 234 may conserve cryogen and increase the overall system efficiency.

The controller 230 may be coupled to a network access device 256. The network access device 256 may include a communication port or channel, such as one or more of a Dedicated Short-Range Communication (DSRC) unit, a Wi-Fi unit, a Bluetooth® unit, a radio frequency identification (RFID) tag or reader, or a cellular network unit for accessing a cellular network (such as 3G, 4G or 5G). The network access device 256 may transmit data to and receive data from a remote device 258. The remote device 258 may be a stationary or a portable computing device including a smartphone, a laptop computer, a desktop computer, a tablet computer, and/or the like. For example, the remote device 258 may use the network access device 256 to communicate with the cryogenic freezer 100, such as monitor and/or control the temperature and/or the amount of cryogen inside the storage chamber 234.

The controller 230 may be coupled to a user interface 260. The user interface 260 may receive user input such as a threshold temperature or a threshold amount of cryogen inside the storage chamber 234. The user input may cause the controller 230 to control the pulsing frequency or timing of the cryogen.

The user interface 260 may provide notifications to the user or other operator, such as when the amount of cryogen inside the storage chamber 234 reaches or exceeds a threshold level. The user interface 260 may display statistics such as the amount of cryogen inside the storage chamber 234, the frequency, length or the timing of pulsing cryogen into the dewar 102, and/or other statistics related to filling the dewar 102 with the cryogen. The user interface 260 may also display alerts, such as the need to increase or decrease the frequency or the timing of the pulsing of the cryogen.

Figure 4:
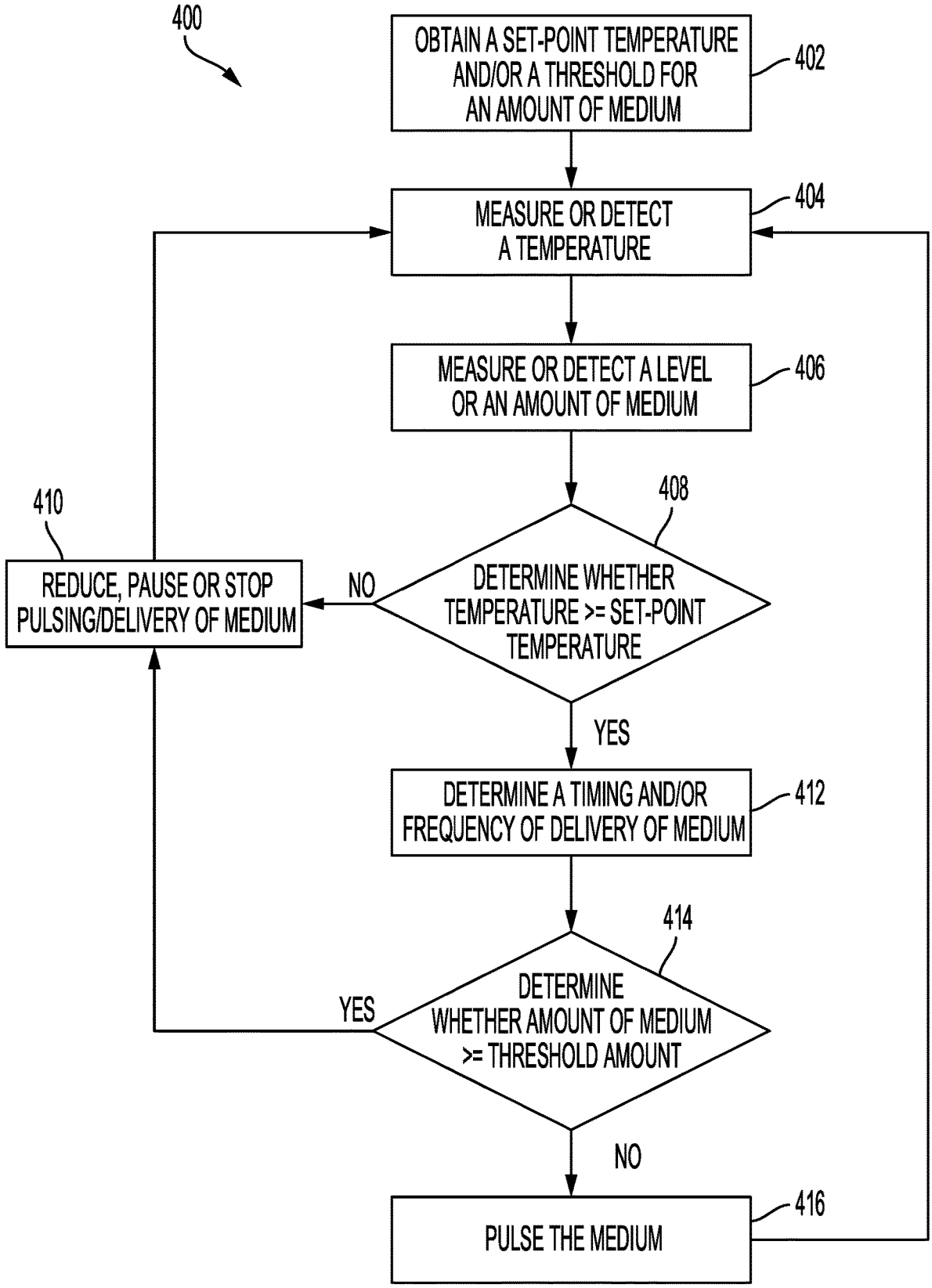
FIG. 4 is a flow diagram of an example process for controlling temperature using the cryogenic freezer of FIG. 1 according to an aspect of the invention.

FIG. 4 is a flow diagram of a process 400 for controlling temperature within the cryogenic freezer 100. One or more computers or one or more data processing apparatuses, for example, the controller 230, appropriately programmed, may implement the process 400. The various components of the cryogenic freezer 100, such as the temperature sensors 216*a,b*, the cryogen level sensor 222, outlet valve 228, cryogen source 240, and cryogen pulse control valve 248 may implement the process 400.

The cryogenic freezer 100 may obtain a set-point temperature and/or a threshold for an amount of medium (402). The user interface 260 may receive user input that indicates the set-point temperature and/or the threshold level of medium. The set-point temperature may be indicative a temperature where cryogenic freezing is insufficient or reduced to maintain the cryogenic temperature to preserve the payload within the storage chamber 234. The threshold level of medium may be indicative of an amount of medium within the storage chamber that would contact the payload that is stored in the storage chamber 234. The set-point temperature and/or the threshold level of medium may be user-inputted, pre-configured, pre-determined or otherwise obtained or determined.

The cryogenic freezer 100 may measure or detect a temperature within the storage chamber 234 (404). The cryogenic freezer 100 may use the temperature sensor 216*a,b* to measure or detect the temperature within the storage chamber 234 of the cryogenic freezer 100. The temperature sensor 216*a* may be positioned at the top of the cylindrical shaft 238 of the turn tray 218 so that the temperature sensor 216*a* is furthest from the medium that is pooled within the storage chamber 234 and that cools the storage chamber 234 and close to the top 110 where ambient air may enter when the top plate 114 of the top 110 is opened. Thus, the temperature sensor 216*a* may be exposed to and measure or detect the warmest temperature within the storage chamber 234. The temperature sensor 216*b* may be positioned at the bottom of the cylindrical shaft 238 to measure or detect a temperature at or near the medium that is pooling within the storage chamber 234. In some implementations, the controller 230 may calculate an average temperature among the one or more measured or detected temperatures from the one or more temperature sensors 216*a,b*. The temperature may be measured, detected, or calculated over a period of time or time interval. The different variations of the temperature may herein be referred to as "temperature" throughout the the specification.

The cryogenic freezer 100 may measure or detect a level or an amount of medium within the storage chamber 234 (406). The cryogenic freezer 100 may use the cryogen level sensor 222 and/or the temperature sensor 216*b* to measure or detect the level or the amount of medium within the storage chamber 234. For example, the cryogenic freezer 100 may detect when the medium contacts the cryogen level sensor 222 to determine that the medium has exceeded a particular amount of medium within the bottom of the storage chamber 234. In another example, when the temperature sensor 216*b* falls below a threshold temperature, this may indicate that the temperature sensor 216*b* is in contact with the medium and that the medium has reached a threshold amount in the bottom of the storage chamber 234. The cryogenic freezer 100 may use the measured or detected level or the amount of medium and the temperature to control the delivery of the medium into the storage chamber 234, e.g., the position of one of more valves, such as the outlet valve 228, that allow the flow of the medium into the storage chamber 234.

The cryogenic freezer 100 may determine whether the temperature is greater than or equal to a set-point temperature (408). The set-point temperature is a temperature or a range of temperatures at which the user desires to maintain the temperature of the storage chamber 234. The temperature sensor 216*a* may be located at the top of the cylindrical shaft 238 of the turn tray 218. When the temperature is less than the set-point temperature, this may indicate that the temperature within the storage chamber 234 is within a temperature range sufficient to maintain the cryogenic temperatures necessary for the payload stored within the storage chamber 234. The cryogenic freezer 100 may reduce, pause or stop the delivery or pulsing of the medium to maintain the temperature within the storage chamber 234 (410). This may include reducing, pausing or stopping the delivery or pulsing of the medium into the storage chamber 234 to allow the temperature within the storage chamber 234 to be maintained below the set-point temperature without delivering too much medium into the storage chamber 234.

The cryogenic freezer 100 may reduce, pause or stop the delivery or pulsing of the medium into the storage chamber 234 to prevent the payload from submerging in the medium that pools within the bottom of the storage chamber 234. The cryogenic freezer 100 may adjust a frequency or a timing, such as reducing a frequency or reducing a length of time, of the delivery of the medium into the storage chamber 234. The controller 230 may control the cryogen pulse control valve 248 and/or the outlet valve 228 to open or close at a decreased frequency or an increased time interval in between openings of the outlet valve 228 and/or remain open for a shorter time interval. The cryogenic freezer 100 then continues to monitor or detect the temperature within the storage chamber 234 (404).

Figure 5:
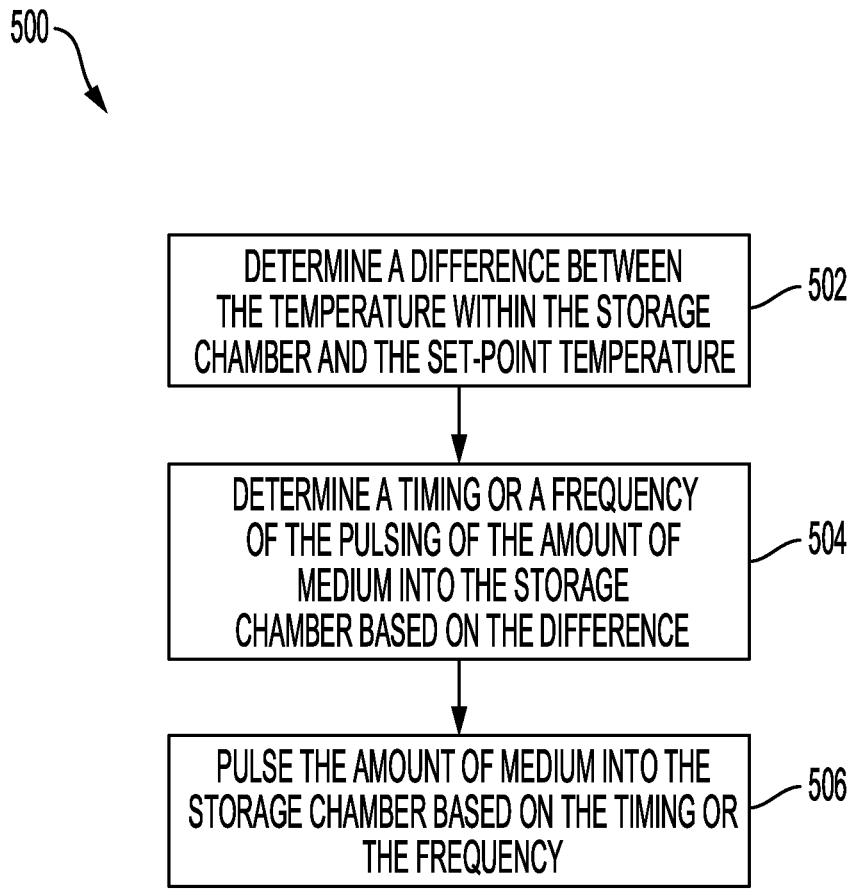
FIG. 5 is a flow diagram of an example process for determining the frequency and timing of the pulsing of the medium using the cryogenic freezer of FIG. 1 according to an aspect of the invention.

Otherwise, when the temperature is greater than or equal to the set-point temperature, the cryogenic freezer 100 may determine a timing and/or frequency of the delivery of the medium to provide additional cooling (412). The timing of the delivery of the medium may refer to a length of time of each pulse of medium that is delivered, which is a result of one or more valves being opened and then closed, and the frequency of the delivery of the medium may refer to the number of pulses of medium that are delivered per time interval, such as per second or per hour. The initial timing and/or the initial frequency may be based on the size of the storage chamber 234 and the set-point temperature to reach a steady-state temperature that is below the set-point temperature, which may be user-configured or calculated by the controller 230. FIG. 5 further describes the process 500 for determining the timing and/or the frequency of the pulsing of the medium into the storage chamber 234. The pulsing of the medium into the storage chamber 234 may provide cooling and/or additional cooling into the storage chamber 234 to maintain the temperature below the set-point temperature and maintain the target temperature for the payload. In various embodiments, the target temperature is a cryogenic freezing temperature.

Once the timing and/or frequency of the pulsing of the medium into the storage chamber 234 is determined, the cryogenic freezer 100 may determine whether the amount or level of the medium is greater than or equal to threshold amount (414). When the amount or level of the medium is greater than or equal to the threshold amount, this may indicate that that the payload in the storage chamber 234 is in contact or submerged underneath the medium that has or is pooling at the bottom of the storage chamber 234. When the payload is in contact or submerged underneath the medium, the medium may contaminate the payload. And so, the cryogenic freezer 100 may reduce, pause or stop the delivery or pulsing of the medium to maintain the temperature within the storage chamber 234 without the payload contacting or submerging underneath the medium, as described above (410).

Otherwise, when the amount or level of the medium is less than the threshold amount, the cryogenic freezer 100 may pulse or continue to pulse the medium into the storage chamber 234 to cool or provide additional cooling within the storage chamber 234 (416). The cryogenic freezer 100 may pulse the medium into the storage chamber 234 based on the determined timing and/or frequency. The cryogenic freezer 100 pulses an amount of medium into the storage chamber 234 when the temperature is greater than or equal to the set-point temperature and when the amount or level of medium is less than the threshold amount. The pulsed medium may be a liquid cryogen or a mixture of gas and liquid. The controller 230 may control the cryogen pulse control valve 248 to transport cryogen to the outlet valve 228 for the outlet valve 228 to expel the medium. The controller 230 may control the outlet valve 228 to fully open or partially open to adjust the rate of the cryogen entering into the storage chamber 234. For example, if the temperature is less than the set-point temperature, the outlet valve 228 may partially open to pulse cryogen at a slower rate. On the other hand, if the temperature is greater than or equal to the set-point temperature, the outlet valve 228 may more fully open the outlet valve 228 to pulse cryogen at a faster rate. FIG. 5 further describes the process of adjusting the amount to open or close the outlet valve 228 to control the pulsing of the medium. Regardless, the cryogenic freezer 100 may continue to monitor the temperature and level or amount of medium in the storage chamber 234 to maintain the temperature within the storage chamber 234 until the cryogenic freezer is deactivated (404).

FIG. 5 is a flow diagram of a process 500 for determining the timing and/or frequency of the pulsing of the medium into the storage chamber using the cryogenic freezer 100. One or more computers or one or more data processing apparatuses, for example, the controller 230, appropriately programmed, may implement the process 500. The various components of the cryogenic freezer 100, such as the temperature sensors 216*a,b*, outlet valve 228, cryogen source 240, and/or cryogen pulse control valve 248 may implement the process 600.

Once the temperature within the storage chamber 234 is determined or detected and the amount of medium is less than the threshold amount, the cryogenic freezer 100 may determine a difference between the temperature within the storage chamber 234 and the set-point temperature (502). The difference may be a measure of the magnitude of the temperature that exceeds the target temperature range to maintain the payload within the storage chamber 234. The target temperature range may be a cryogenic temperature range. The difference may correlate or correspond with the amount of additional cooling that is necessary to reduce the temperature to below the set-point temperature. For example, the larger the difference, the more additional cooling that is required to cool the storage chamber 234 to bring the temperature down below the set-point temperature.

After the difference is determined between the temperature within the storage chamber, the cryogenic freezer 100 may determine the timing or a frequency of the pulsing of the amount of cryogen into the storage chamber 234 based on the difference (504). The timing or the frequency may be measured in pulses per hour, pulses per minute, or pulses per second for example. The timing or the frequency may be directly proportional to the difference between the temperature and the set-point temperature where the set-point temperature is lower than the temperature. As the difference between the temperature and the set-point temperature increases, the frequency may increase and/or the time interval that the pulse is "ON", e.g., when the outlet valve 228 is open or partially open and discharging the medium into the storage chamber 234, may increase. And as the difference between the temperature and the set-point temperature decreases, the frequency may decrease and/or the time interval that the pulse is "ON" may decrease.

The cryogenic freezer 100 may pulse the amount of cryogen into the storage chamber 234 based on the timing or the frequency (506). The pulsed cryogen may be liquid or a mixture of gas and liquid. The controller 230 may control the cryogen pulse control valve 248 to transport cryogen to the outlet valve 228 for the outlet valve 228 to expel the cryogen at the determined timing or frequency. The controller 230 may cause an actuator to open or close the cryogen pulse control valve 248 and/or the outlet valve 228 to form pulses of medium that flow or are discharged into the storage chamber 234. The controller 230 opens the cryogen pulse control valve 248 and/or the outlet valve 228 to turn the pulse of medium "ON" and closes the cryogen pulse control valve 248 and/or the outlet valve 228 to turn the pulse of medium "OFF". The amount that the cryogen pulse control valve 248 and/or the outlet valve 228 is opened controls the flow rate of the medium into the storage chamber 234 while length of time that the cryogen pulse control valve 248 and/or the outlet valve 228 is opened controls the time interval or length of the pulse of the medium. The controller controls the frequency and timing by cycling the cryogen pulse control valve 248 and/or the outlet valve 228 between an open, partially open, and/or closed position, which creates the pulsing "ON" and "OFF" effect of the flow of medium into the storage chamber 234 and controls the amount of cooling and/or the amount of medium that pools within the bottom of the storage chamber 234 before evaporation.

Exemplary embodiments of the methods/systems have been disclosed in an illustrative style. Accordingly, the terminology employed throughout should be read in a non-limiting manner. Although minor modifications to the teachings herein will occur to those well versed in the art, it shall be understood that what is intended to be circumscribed within the scope of the patent warranted hereon are all such embodiments that reasonably fall within the scope of the advancement to the art hereby contributed, and that that scope shall not be restricted, except in light of the appended claims and their equivalents.

What is claimed is:

1. A freezer, comprising:

an outer vessel;

an inner vessel positioned within the outer vessel and defining a storage chamber;

a first sensor configured to measure a temperature within the storage chamber; and a controller coupled to the first sensor and configured to:

determine a difference between the temperature within the storage container and a set point temperature;

pulse an amount of medium into the storage container to control the temperature within the storage container; and determine a timing or a frequency of the pulsing of the amount of medium into the storage container based on the difference, wherein the controller is configured to pulse the amount of medium into the storage container based on the timing or the frequency.

2. The freezer of claim 1, further comprising:

a turn tray positioned within the inner vessel and configured to hold a number of storage areas, wherein the first sensor is positioned adjacent to the turn tray.

3. The freezer of claim 2, further comprising:

a second sensor positioned at a bottom of the turn tray and configured to detect or measure the amount of medium within the storage chamber, wherein the controller is configured to pulse the amount of medium within the storage chamber further based on the detected or measured amount of medium within the storage chamber.

4. The freezer of claim 3, wherein to pulse the amount of medium within the storage chamber the controller is configured to:

decrease a frequency or a timing of the pulse when the detected or measured amount of medium within the storage chamber is greater than or equal to a threshold amount or when the temperature is less than a threshold temperature; and increase the frequency or the timing of the pulse when the detected or measured amount of medium within the storage chamber is less than the threshold amount and when the temperature is greater than the threshold temperature.

5. The freezer of claim 1, further comprising:

an outlet that is positioned at a bottom of the storage chamber and configured to deliver or disperse medium into the storage chamber; and a medium source that is in fluid communication with the outlet and configured to provide the medium through one or more conduits and out the outlet to deliver or disperse the medium into the storage chamber.

6. The freezer of claim 5, wherein the controller is coupled to the medium source and the outlet and to pulse the amount of medium into the storage container the controller is configured to:

adjust a position of an outlet valve to open, partially open or close the outlet; or control the medium source to provide the medium through to the outlet valve.

7. The freezer of claim 5, wherein the medium source is a storage container containing a supply of the medium and the medium is a cryogen refrigerant including liquid nitrogen, wherein the liquid nitrogen is pressurized for transfer to the outlet.

8. A freezer for using cryogen as a refrigerant, comprising:

an inner vessel defining a storage chamber;

an outer vessel surrounding the inner vessel and defining a vacuum-insulated space in between the outer vessel and the inner vessel;

a temperature sensor configured to measure a temperature within the storage chamber; and a controller coupled to the temperature sensor and configured to:

determine a difference between the temperature within the storage container and a set point temperature;

pulse an amount of cryogen into the storage container to control the temperature within the storage container; and determine a timing or a frequency of the pulsing of the amount of medium into the storage container based on the difference, wherein the controller is configured to pulse the amount of medium into the storage container based on the timing or the frequency.

9. The freezer of claim 8, further comprising:

a turn tray positioned within the inner vessel and configured to hold a number of storage areas, wherein the temperature sensor is positioned adjacent to the turn tray.

10. The freezer of claim 9, further comprising:

a cryogen level sensor configured to detect or measure the amount of cryogen within the storage chamber, wherein the controller is configured to pulse the amount of cryogen within the storage chamber further based on the detected or measured amount of cryogen within the storage chamber.

11. The freezer of claim 10, wherein to pulse the amount of cryogen within the storage chamber the controller is configured to:

decrease a frequency or a timing of the pulse when the detected or measured amount of cryogen within the storage chamber is greater than or equal to a threshold amount or when the temperature is less than a threshold temperature; and increase the frequency or the timing of the pulse when the detected or measured amount of cryogen within the storage chamber is less than the threshold amount or when the temperature is greater than the threshold temperature.

12. The freezer of claim 8, further comprising:

an outlet configured to deliver or disperse cryogen into the storage chamber; and a cryogen source that is in fluid communication with the outlet and configured to provide the cryogen through one or more conduits and out the outlet to deliver or disperse the medium into the storage chamber.

13. The freezer of claim 12, wherein the controller is coupled to the cryogen source and the outlet and to pulse the amount of cryogen into the storage container the controller is configured to:

adjust a position of a outlet valve to open, partially open, or close the outlet; or control the cryogen source to provide the cryogen through to the outlet.

14. The freezer of claim 12, wherein the cryogen source is a storage container containing a supply of the cryogen that includes liquid nitrogen, wherein the liquid nitrogen is pressurized for transfer to the outlet.

15. A method of controlling temperature within a cryogenic freezer, comprising:

measuring or detecting, by a processor and using a temperature sensor, a temperature within a storage chamber of the cryogenic freezer;

determining, by the processor, whether the temperature is greater than or equal to a set-point temperature; and pulsing, by the processor and using an outlet and a cryogen source, an amount of cryogen into the storage chamber when the temperature is greater than or equal to the set-point temperature;

determining a difference between the temperature within the storage chamber and the set-point temperature;

determining a timing or a frequency of the pulsing of the amount of cryogen into the storage chamber based on the difference; and pulsing the amount of cryogen into the storage chamber based on the timing or the frequency.

16. The method of claim 15, comprising:

measuring or detecting, by the processor and using a cryogen level sensor, the amount of cryogen in the storage chamber; and pulsing, by the processor and using the outlet and the cryogen source, the amount of cryogen into the storage chamber based on the amount of cryogen in the storage chamber.

17. The method of claim 16, wherein pulsing the amount of cryogen within the storage chamber includes:

decreasing a frequency or a timing of the pulse when the detected or measured amount of cryogen within the storage chamber is greater than or equal to a threshold amount or when the temperature is less than a threshold temperature; and increasing the frequency or the timing of the pulse when the detected or measured amount of cryogen within the storage chamber is less than the threshold amount or when the temperature is greater than the threshold temperature.

* * * * *